US007069620B2

(12) United States Patent
Bagwell

(10) Patent No.: US 7,069,620 B2
(45) Date of Patent: Jul. 4, 2006

(54) FLOOR TOOL

(75) Inventor: Martin Paul Bagwell, Hampshire (GB)

(73) Assignee: Dyson Technology Limited, Wiltshire (GB)

( * ) Notice: Subject to any disclaimer, the term of this patent is extended or adjusted under 35 U.S.C. 154(b) by 450 days.

(21) Appl. No.: 10/363,918

(22) PCT Filed: Sep. 17, 2001

(86) PCT No.: PCT/GB01/04147

§ 371 (c)(1),
(2), (4) Date: Mar. 10, 2003

(87) PCT Pub. No.: WO02/26097

PCT Pub. Date: Apr. 4, 2002

(65) Prior Publication Data

US 2003/0163889 A1 Sep. 4, 2003

(30) Foreign Application Priority Data

Sep. 28, 2000 (GB) ..... 0023732.1

(51) Int. Cl.
*A47L 9/06* (2006.01)

(52) U.S. Cl. ..... 15/398; 15/401

(58) Field of Classification Search ..... 15/393, 15/398, 399, 400, 415.1, 422.1
See application file for complete search history.

(56) References Cited

U.S. PATENT DOCUMENTS

| | | | | | |
|---|---|---|---|---|---|
| 4,180,887 | A | * | 1/1980 | Wudel et al. | 15/415.1 |
| 4,336,628 | A | * | 6/1982 | Bradshaw et al. | 15/415.1 |
| 4,458,378 | A | * | 7/1984 | Helmes | 15/415.1 |
| 4,564,972 | A | | 1/1986 | Varin | |
| 4,888,852 | A | * | 12/1989 | Varin | 15/400 |
| 5,497,532 | A | * | 3/1996 | Glatz | 15/401 |
| 5,564,161 | A | * | 10/1996 | Glatz | 15/415.1 |

FOREIGN PATENT DOCUMENTS

| | | | |
|---|---|---|---|
| DE | 72 37 505.4 | | 3/1974 |
| DE | 30 09 648 | A1 | 9/1981 |
| EP | 0 018 524 | A1 | 11/1980 |
| EP | 0 023 301 | A1 | 2/1981 |
| EP | 0304609 | * | 3/1989 |
| EP | 0 353 546 | A1 | 2/1990 |
| EP | 0 885 586 | B1 | 12/1998 |
| JP | 52-048276 | * | 10/1975 |
| JP | 4-343819 | * | 11/1992 |
| JP | 4-343820 | * | 11/1992 |
| JP | 5-84178 | * | 4/1993 |
| JP | 5-261038 | * | 10/1993 |

* cited by examiner

*Primary Examiner*—Terrence R. Till
(74) *Attorney, Agent, or Firm*—Morrison & Foerster LLP

(57) ABSTRACT

A floor tool for use in vacuum cleaning floor surfaces includes a sole plate that has a suction channel formed in it. The suction channel is bounded on at least one side by a working edge for engaging with the floor surface. Lint pickers are positioned alongside the suction channel and are separated from the suction channel by the working edge. The lint pickers are mounted on a surface of the floor tool which is inclined with respect to the plane in which the working edges lie. The sole plate is pivotally mounted with respect to a suction outlet so that movement of the floor tool in a forward and backwards direction alternately brings one of the working edges into closer contact with the floor surface.

10 Claims, 6 Drawing Sheets

FLOOR TOOL

FIELD OF THE INVENTION

This invention relates to a floor tool for use with a vacuum cleaner.

BACKGROUND OF THE INVENTION

Cylinder or canister vacuum cleaners, as shown in FIG. 1, generally comprise a main body 10 which contains separating apparatus 11 such as a cyclonic separator or a bag for separating dirt and dust from an incoming dirty airflow. The dirty airflow is introduced to the main body 10 via a hose 15 and wand 16 assembly which is connected to the main body 10. The main body 10 of the cleaner is dragged along by the hose as a user moves around a room. A cleaning tool 20 is attached to the remote end 17 of the hose and wand assembly. A range of cleaning tools are usually supplied so that a user can choose an appropriate tool for their cleaning task, such as crevice tool and a brush tool. The cleaning tool which is used for general cleaning is a floor tool 20. FIG. 2 shows the underside of a floor tool sold by DYSON™ and shown more fully in Registered Design GB 2,074,319. The floor tool 20 is a wide tool with a sole plate on its lower side that glides over the floor surface. The sole plate has a suction inlet 21 and a suction channel 22–25 communicating with the inlet 21. The tool 20 is pushed backwards and forwards across a floor surface by a user. Air is drawn into the inlet 21 via the suction channels 22–25. Air reaches the channels 22–25 via inlets at the edges of the tool and via leakage between the sole plate of the tool and the floor surface. As the floor tool 20 passes over the floor surface, dirt, dust and other debris is carried along the suction channels 22–25 to the suction inlet 21 and along the hose and wand 15, 16 to the separator 11 in the main body 10 of the vacuum cleaner.

While floor tools of the kind shown in FIG. 1 work well on hard floor surfaces, they are less effective on carpeted floors where hair, fluff and other fibrous material, collectively called 'lint', become trapped on the carpet. Thus, efforts have been made to improve the pick up performance of floor tools on carpeted floors. Some tools have a brush mounted in the suction inlet which is rotated so as to agitate the floor surface in the same manner as the brush bar of an upright vacuum cleaner. The brush can be rotated by the use of an air turbine or by an electric motor which is powered by a power supply derived from the main body of the cleaner. However, this type of tool is more expensive than the passive floor tool.

Efforts have also been made to improve floor tools in a more passive manner. Floor tools usually have one or more lint pickers 30, 35 mounted on the sole plate. A lint picker is a strip of material into which a plurality of tufts of fine hair are secured. All of the tufts are aligned in the same direction with respect to the sole plate. The lint picker acts as a one-way gate, allowing lint to pass under the lint picker when the floor tool is pushed along the floor, but to block the lint when the floor tool is pulled backwards. The repeated forward and backwards action of the floor tool across the floor surface traps the lint and rolls it into a ball such that it can be sucked by the floor tool. Each lint picker is mounted within a recessed portion of the sole plate. However, the pick-up performance of such tools is limited.

SUMMARY OF THE INVENTION

The present invention seeks to improve the pick-up performance of a passive floor tool.

An aspect of the present invention provides a floor tool for use in vacuum cleaning floor surfaces comprising a sole plate comprising a suction channel, the channel being bounded on at least one side by a working edge and a lint picker which is positioned alongside the suction channel and is separated from the suction channel by the working edge, wherein the working edge is suitable for engaging with and agitating a floor surface across its full width, all of the working edge lying in the same plane.

It has been found unnecessary to recess the lint picker and to break the working edge in order to accommodate the lint picker. Positioning the lint picker such that it is separated from the suction channel by the working edge provides a full effective working edge which maximises agitation to the floor surface. The lint picker is also able to operate on the floor surface.

Preferably the lower face of the floor tool adjacent to the working edge and on the side of the working edge remote from the suction channel is inclined with respect to the plane in which the working edges lie. This supports the lint pickers such that they are close enough to the floor surface to provide a useful action.

Preferably, agitation is further improved by providing a working edge with a sharply defined, angular, edge with a minimal radius of curvature. An edge having a radius of around 0.2 mm has been found to be effective.

The pick up performance of the tool is further improved by pivotably supporting the floor tool such that the working edges on each side of the suction channel are alternately brought into contact with the floor surface as the floor tool is pushed and pulled across the surface. As one of the working edges is brought into contact with the floor surface, the other raises slightly to allow air to bleed into the suction channel. This improves the agitating effect on the floor surface and reduces the motion resistance or push-force required to move the floor tool.

BRIEF DESCRIPTION OF THE DRAWINGS

Embodiments of the present invention will now be described with reference to the accompanying drawings, in which.

DETAILED DESCRIPTION OF THE INVENTION

Figure 3:
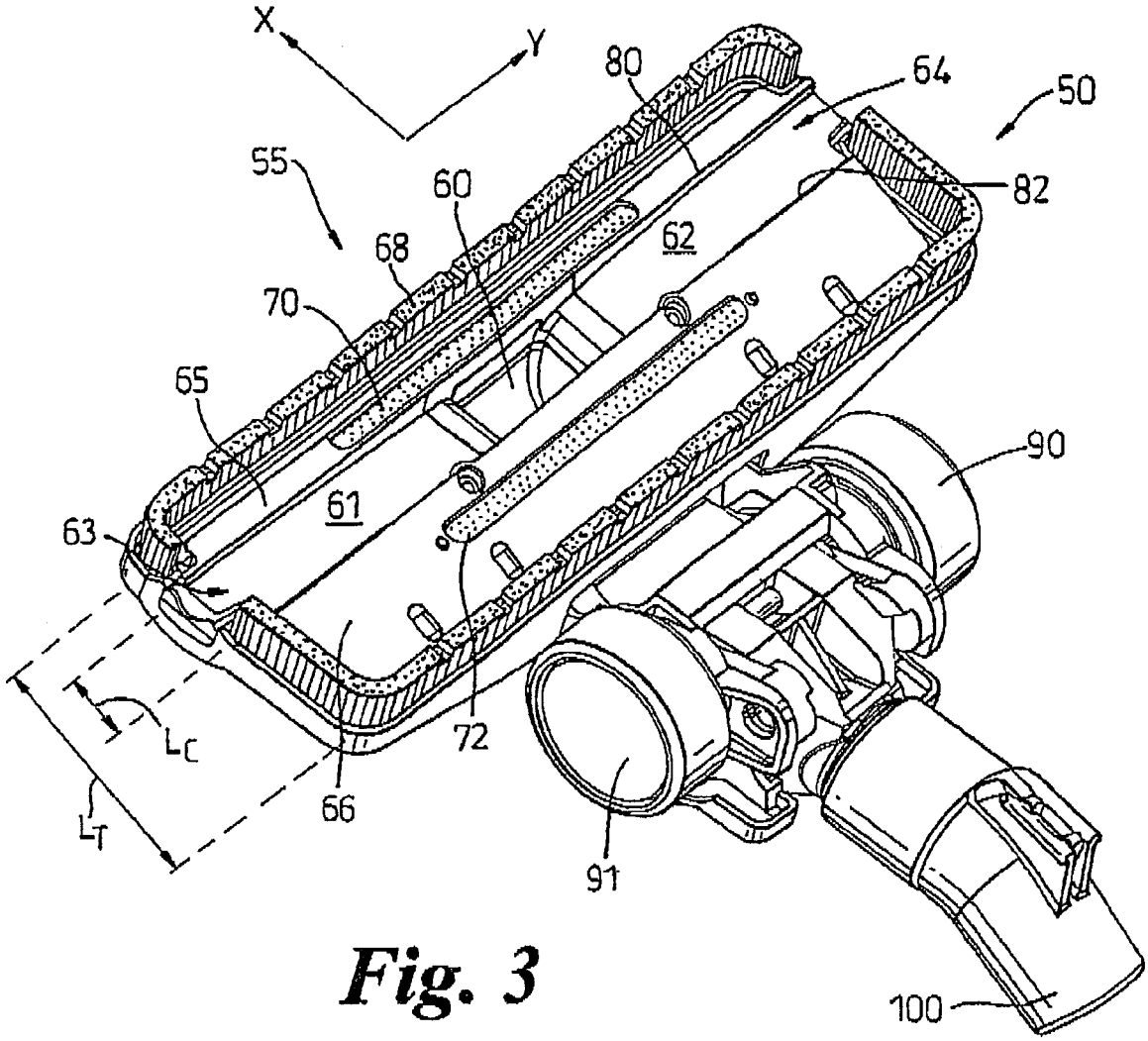
FIG. 3 shows a floor tool in accordance with an embodiment of the invention.
Figure 4:
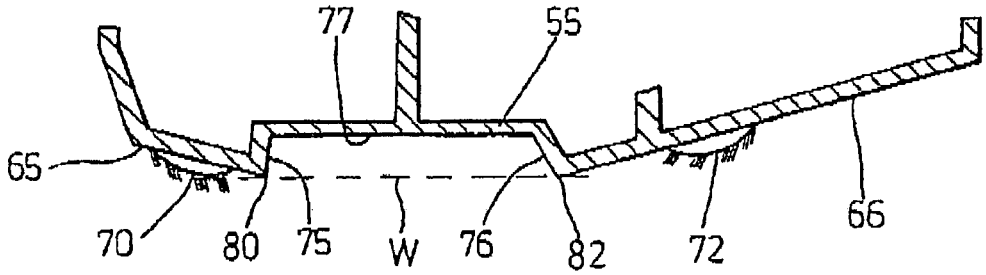
FIG. 4 is a cross-section through the sole plate of the floor tool of FIG. 3.

As shown in FIGS. 3 and 4, the floor tool 50 comprises a housing having a lower plate 55, or sole plate, which is intended to ride along a floor surface. The sole plate 55 is fully shown in FIG. 3. For case of understanding in the following description, the arrowed line X in FIG. 3 indicates the longitudinal direction and the arrowed line Y the transverse direction. The sole plate 55 has a centrally mounted air inlet 60 which communicates via a conduit to the outlet 100.

Figure 1:
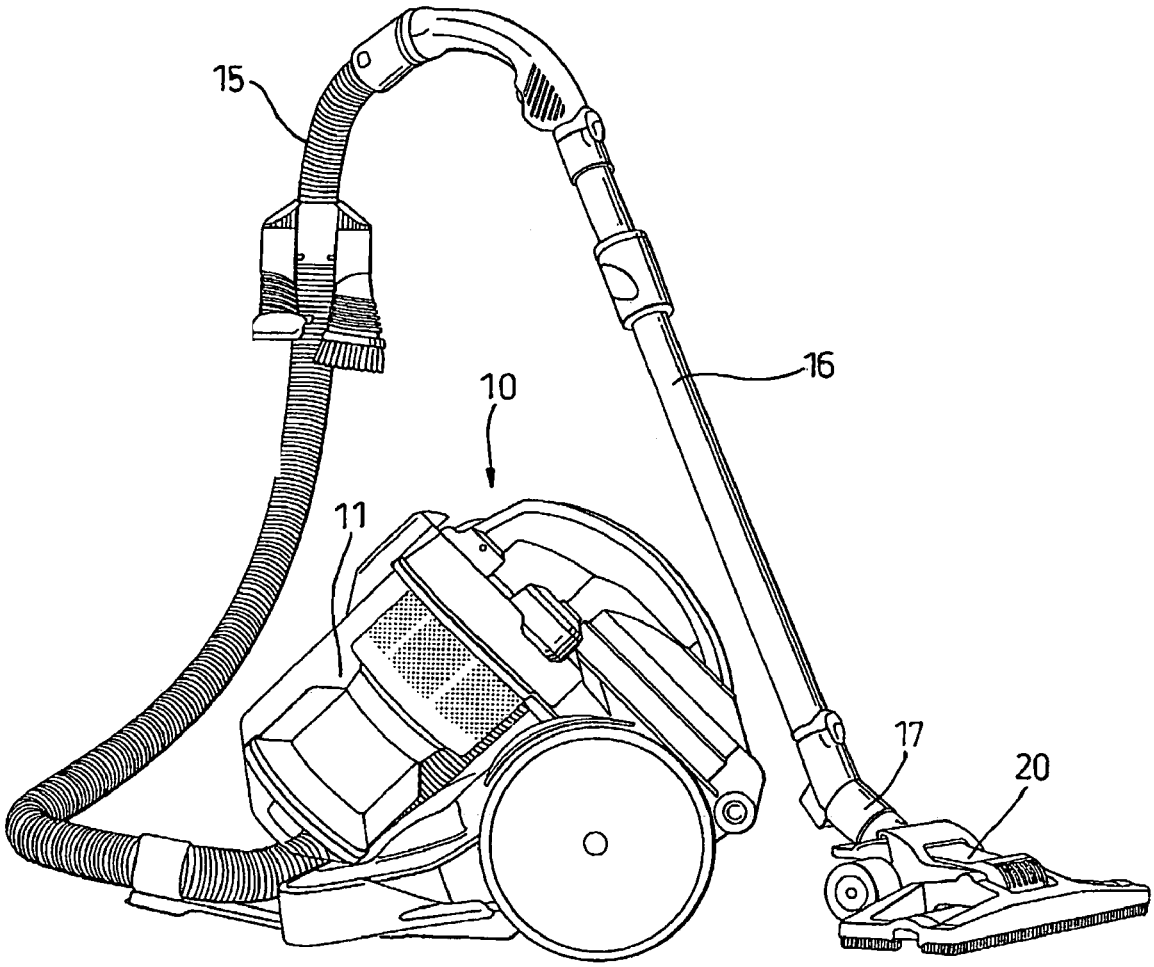
Fig. 1 PRIOR ART
FIG. 1 shows a known cylinder type of vacuum cleaner.
Figure 2:
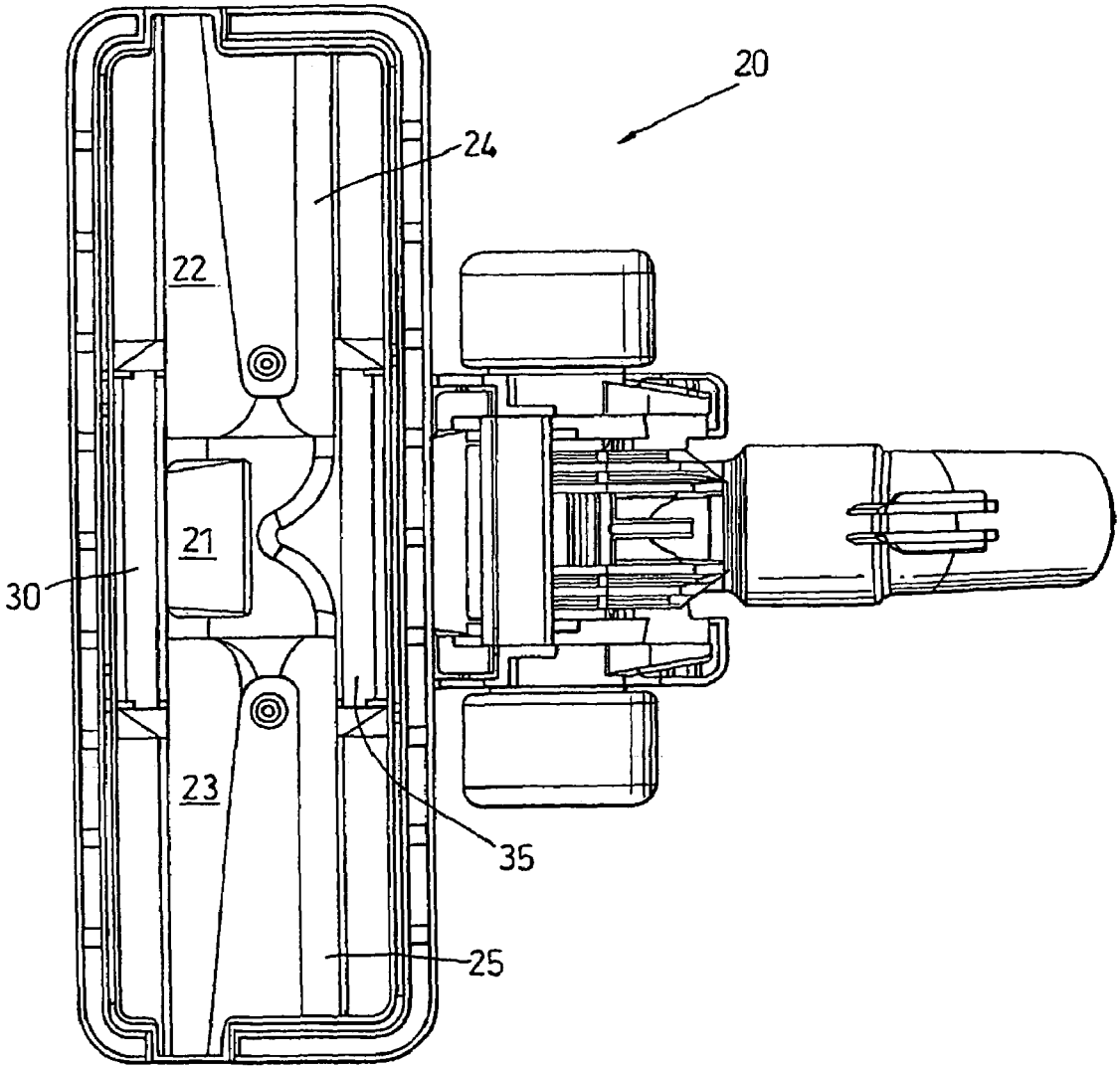
Fig. 2 PRIOR ART
FIG. 2 shows a known type of floor tool for use with the cleaner of FIG. 1.

Outlet 100 is suitably dimensioned to connect to a hose or wand of a vacuum cleaner as shown in FIG. 1. Two suction channels 61, 62 extend transversely across the tool each side of the inlet 60. Each channel decreases in depth towards the sides of the tool and terminates in an inlet 63, 64 on the side of the tool. The length of channel 61, 62 ($L_C$) is shown here as being about one third of the total length ($L_T$) of the tool but this proportion can be varied. The side walls 75, 76 of the channels 61, 62 are sharply angled with respect to the inner face 77 of the channels. Forwardly and rearwardly of the suction channel 61, 62, the sole plate is formed as two planar surfaces 65, 66 which are inclined with respect to a plane W in which the working edges 80, 82 both lie. The intersection between the planar surface 65 and side wall 75 of the channel is a forward working edge 80 and the intersection between the planar surface 66 and side wall 76 of the channel is a rearward working edge 82. The working edges are sharply defined, as shown in FIG. 4, so as to provide an effective agitating action when the floor tool is used on carpeted surfaces. A radius of curvature of 0.15 mm on the working edges 80, 82 has been found to be effective although it will be apparent that a range of other values could also provide a similarly effective agitating action. The working edges 80, 82 extend across the full width of the floor tool. Lint pickers 70, 72 are positioned on the planar surfaces 65, 66 and are spaced from the working edges 80, 82 so that the working edges can perform an agitating action on carpeted surfaces across their full width. Each of the lint pickers 70, 72 is of a conventional type, comprising a strip of material in which a plurality of tufts of fine fibre are secured. Each lint picker 70, 72 is secured on an arcuately-shaped support that extends outwardly from the planar surface 65, 66 on which it is located, as shown in FIG. 4. The spacing of the lint pickers 70, 72 from the adjacent working edge 80, 82 can be varied from the spacing as shown in the drawings. For example, lint picker 72 could be positioned nearer to working edge 82. The lint pickers in FIG. 3 are approximately one third to one half of the total width of the tool 50. The use of lint pickers causes an increase in the force that a user requires to push or pull the floor tool across a floor surface. It would be possible to increase the width of the lint pickers 70, 72 to substantially equal to the total width of the floor tool although this would incur an increase in the push force required by a user.

Figure 5:
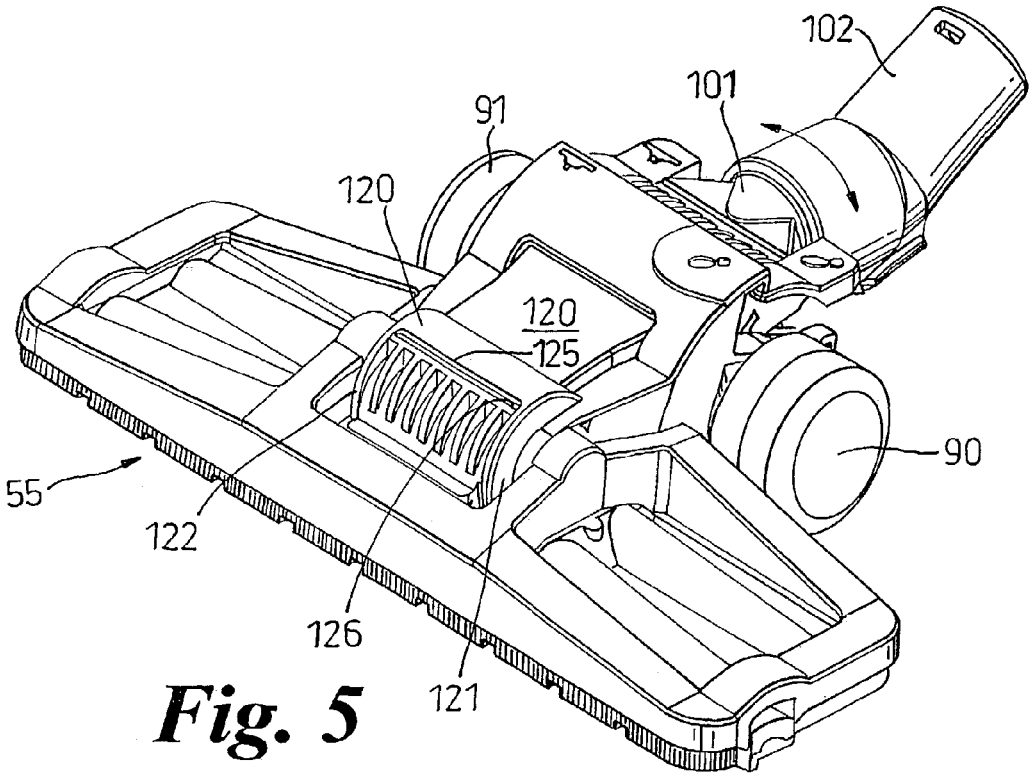
FIG. 5 shows an isometric view of the floor tool in accordance with an embodiment of the invention.
Figure 6:
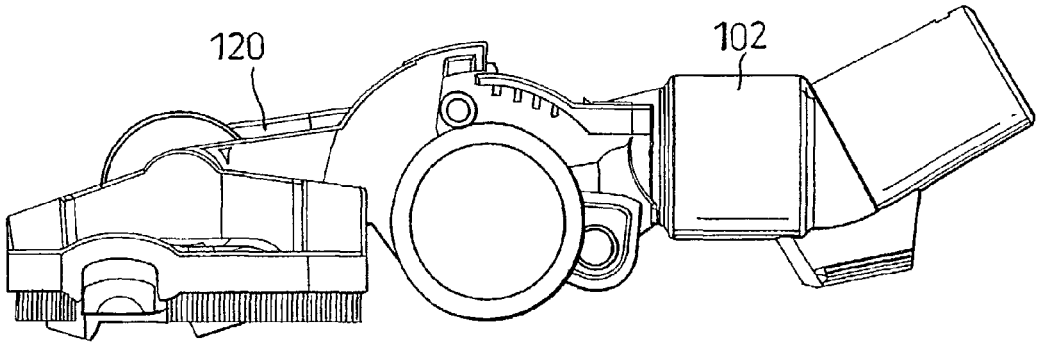
FIG. 6 is a side view of the floor tool of FIG. 5.
Figure 8:
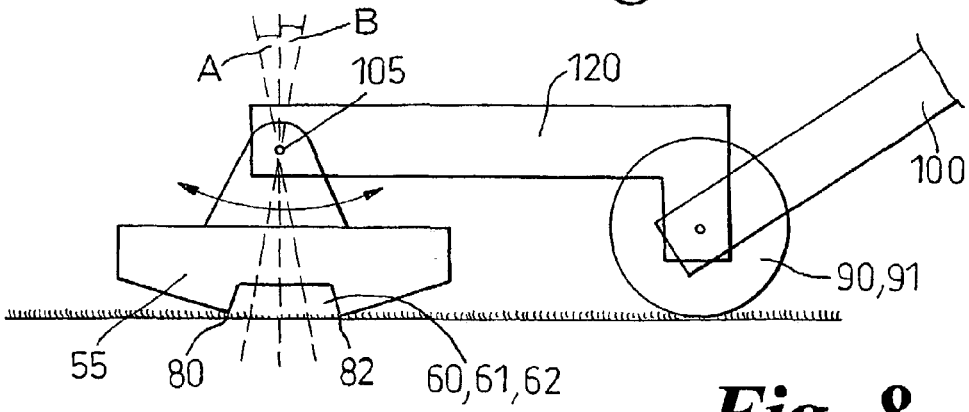
FIG. 8 is a simplified cross-section of the floor tool.

FIG. 8 is a simplified cross-section of the floor tool, showing the main parts of the tool. Sole plate 55 is pivotally connected at 105 to a support member 120. The support member 120 supports wheels or rollers 90, 91 for rolling along the floor surface and also has as a suction conduit for guiding air from the sole plate 55. The support member 120 is pivotally connected at its rearmost end to the outlet pipe 100. FIG. 8 shows the pivotal connection between the sole plate 55 and support member 120 as being directly above the centre of the suction channel 60, 61, 62. This is the ideal position of the pivotal connection. The embodiment shown in FIGS. 5–7 has the pivotal connection 105 above the suction channel 60, 61, 62 but offset from the dead centre of the suction channel.

The sole plate 55 pivotally connects to the support member 120. The connection between the sole plate 55 and support member 120 allows a limited degree of movement between these parts while maintaining a good seal between the parts. Movement of the sole plate 55 is restricted by projections 123, 124 (FIG. 7) and 125 (FIG. 5) on the support member 120. Anti-clockwise (rearward) movement of the sole plate is restricted by the projections 123, 124 which engage with the upper surface of the sole plate. Clockwise (forward) movement of the sole plate 55 is restricted by surface 125 of the support member 120 which extends radially outwardly from the pivot point 105 between arms 121, 122. A corresponding radially extending surface 126 on the sole plate 55 lies flat against surface 125 when the extent of forward movement has been reached.

Figure 7:
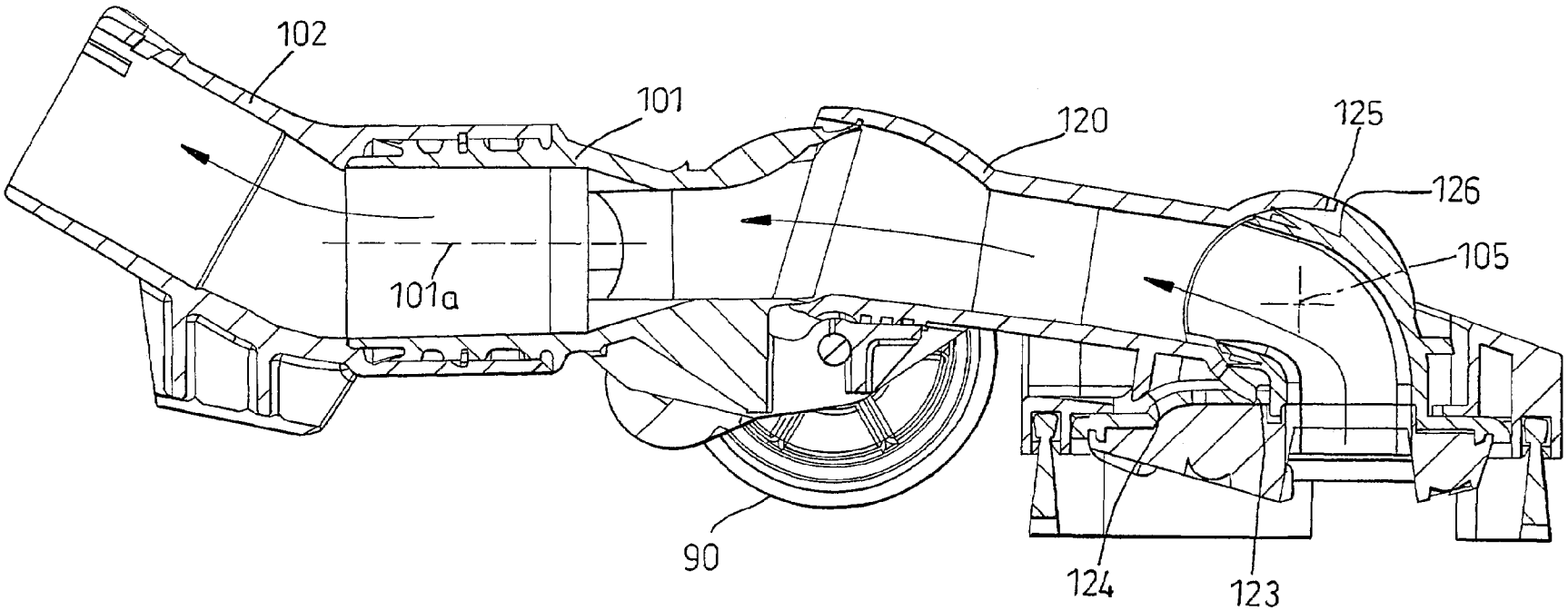
FIG. 7 is a cross-section through the floor tool.

As shown in FIG. 7, the outlet 100 comprises a first part 101 and a second part 102. The first part 101 is pivotally mounted to the support member 120 about an axis passing through the centres of the wheels 90, 91. The second part 102 is an angled pipe which is rotatably connected to the distal end of the first part 101 about the longitudinal axis 101*a* of the part 101 so as to allow rotation of the angled pipe 102. Such an arrangement allows a good level of maneuverability of the floor tool when in use and is commonly employed in known floor tools. The angled pipe portion 102 is shaped and dimensioned so as to be connectable to the wand 16 of a domestic vacuum cleaner, as shown in FIG. 1. In use, air is drawn through the tool in the directions of the arrowed lines.

Figure 9:
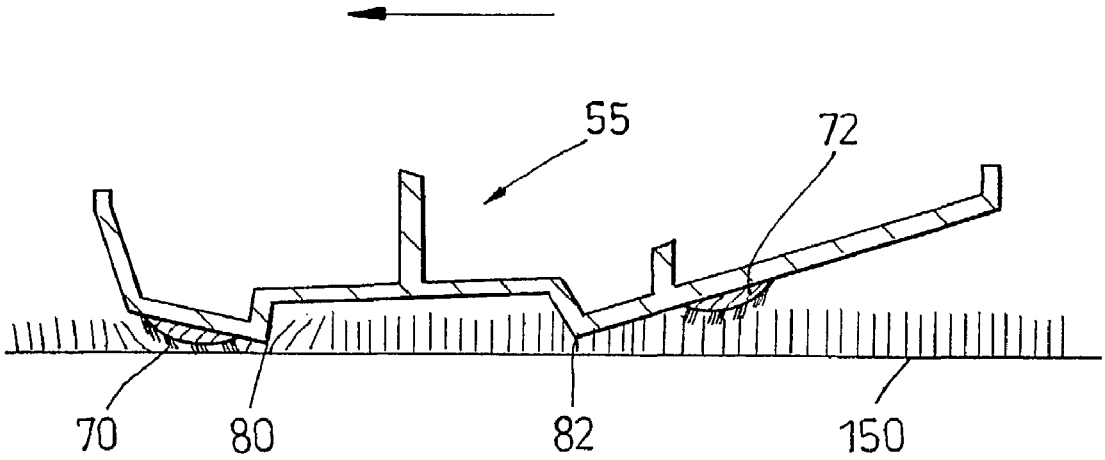
FIGS. 9 and 10 show the sole plate of the floor tool in use as the tool is moved forwardly and backwardly across a floor surface.
Figure 10:
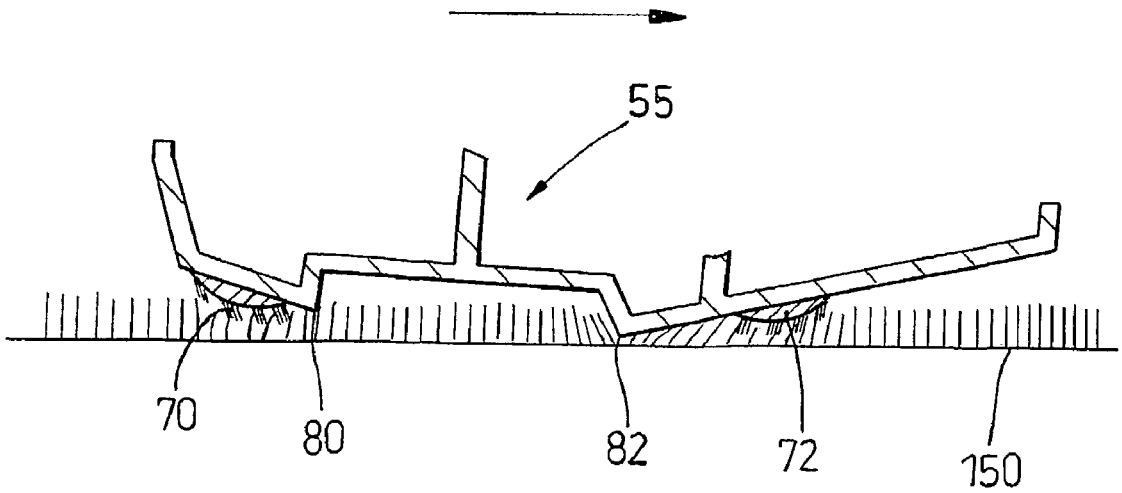

FIGS. 9 & 10 show how the floor tool 50 operates in use. Firstly, FIG. 9 shows the floor tool 50 as it is pushed forwardly across a floor surface. As the tool is pushed forwardly, the sole plate 55 rotates about pivot 105 (FIG. 7), bringing the forward working edge 80 into closer contact with the floor surface 150 than the rear working edge 82. The sharp edge 80 has an effective agitating effect on the surface, parting the pile of the surface and releasing dirt in a flicking action. As dirt is released, it is swept along the suction channel 61, 62 by the airflow in the suction channel towards suction inlet 60. Also, forward lint picker 70 is brought into contact with the floor surface. In its lowered position, the forward lint picker 70 allows lint to pass. The rear lint picker 72 remains close enough to the surface to serve a useful blocking action on lint.

FIG. 10 shows the floor tool 50 as it is pushed rearwardly across a floor surface. As the tool is pushed rearwardly, the sole plate 55 rotates about pivot 105, bringing the rear working edge 82 into closer contact with the floor surface 150 than the forward working edge 80. The sharp edge 82 has the same effect as forward edge 80 did during the forward action, i.e. it agitates the surface, parting the pile of the surface and releasing dirt in a flicking action. Dirt is swept along the suction channel 61, 62 by the airflow in the suction channel towards suction inlet 60. Rear lint picker 72 is brought into contact with the floor surface 150 and allows lint to pass. The forward lint picker, while raised higher than it would be during the forward action, remains close enough to the surface 150 to block the passage of lint. It can be seen that once the floor tool has passed over lint, the lint becomes trapped between the lint pickers and is prised from the surface.

In a conventional manner, the floor tool 50 also comprises a skirt 68 of flexible bristles which surrounds, but is not part of, the sole plate 55. The skirt 68 is movable between a deployed position, for use with cleaning hard floors, in which the skirt rides along the hard floor surface and serves to space the sole plate 55 from the floor surface, and a retracted position, for use when cleaning carpets, where the sole plate 55 is able to contact the floor surface and the skirt 68 is retracted sufficiently not to impede movement of the floor tool across the carpeted surface.

The invention claimed is:

1. A floor tool for use in vacuum cleaning floor surfaces, comprising a sole plate comprising a suction channel, the channel being bounded on front and rear sides by two continuous working edges extending the width of the floor tool and lying in a common plane, the working edges lying adjacent corresponding lower faces of the sole plate which are inclined with respect to the plane in which the working edges lie, and lint pickers mounted on the lower faces, each lint picker being positioned alongside the suction channel and separated from the suction channel by its corresponding working edge, wherein the working edges are configured so as to alternatively engage with and agitate a floor surface across their full widths.

2. A floor tool according to claim 1, wherein the suction channel extends across the tool transversely to the direction in which the tool is configured to be pushed across the floor surface.

3. A floor tool according to claim 1, wherein the lint pickers are mounted on supports which project outwardly from the inclined lower faces.

4. A floor tool according to claim 3, wherein the supports are arcuately shaped.

5. A floor tool according to claim 1, wherein the sole plate is pivotally mounted with respect to the suction outlet such that movement of the floor tool in a forward and backwards direction alternately brings one of the working edges in closer contact with the floor surface.

6. A floor tool according to claim 1, 2 or 5, wherein the working edges are angular edges.

7. A floor tool according to claim 6, wherein each working edge has a radius of curvature substantially equal to 0.2 mm.

8. A floor tool according to claim 1, 2 or 5, wherein the lint pickers extend across more than one third of the width of the suction channel.

9. A floor tool according to claim 7, wherein the lint pickers extend across substantially one half of the width of the suction channel.

10. A floor tool according to claim 8, wherein the lint pickers extend across substantially the full width of the suction channel.

* * * * *